United States Patent [19]

Das

[11] Patent Number: 4,739,841

[45] Date of Patent: Apr. 26, 1988

[54] METHODS AND APPARATUS FOR CONTROLLED DIRECTIONAL DRILLING OF BOREHOLES

[75] Inventor: Pralay K. Das, Sugar Land, Tex.

[73] Assignee: Anadrill Incorporated, Sugar Land, Tex.

[21] Appl. No.: 896,891

[22] Filed: Aug. 15, 1986

[51] Int. Cl.[4] ..... E21B 7/08; E21B 47/022

[52] U.S. Cl. ..... 175/61; 175/45

[58] Field of Search ..... 175/45, 61; 73/151; 33/304, 313

[56] References Cited

U.S. PATENT DOCUMENTS

| | | | |
|---|---|---|---|
| 2,930,137 | 3/1960 | Arps | 33/312 |
| 4,303,994 | 12/1981 | Tanguy | 33/304 |
| 4,324,297 | 4/1982 | Denison | 175/45 |
| 4,384,483 | 5/1983 | Dellinger et al. | 175/45 |
| 4,445,578 | 5/1984 | Millheim | 175/45 |
| 4,479,564 | 10/1984 | Tanguy | 33/304 |
| 4,662,458 | 5/1987 | Ho | 175/27 |

OTHER PUBLICATIONS

"Application of Side-Force Analysis and MWD to Reduce Drilling Costs" by R. G. Whitten, Mar. 1987, SPE/IADC 16113.

"Three-Dimensional Bottomhole Assembly Model Improves Directional Drilling" by P. M. Jogi, T. M. Burgess, J. P. Bowling, Feb. 1986, IADC/SPE 14768.

"Field Measurements of Downhole Drillstring Vibrations" by S. F. Wolf, M. Zacksenhouse, A. Arian, Sep. 1985, SPE 14330.

"Side Cutting Characteristics of Rock Bits and Stabilizers While Drilling" by K. K. Millheim & T. M. Warren, Oct. 1978, SPE 7518.

"Analysis of Drillstrings in Curved Boreholes" by F. J. Fischer, Oct. 1974, SPE 5071.

"Maximum Permissible Drillbit Weight from Drillcollars in Inclined (Directional) Boreholes" by B. J. Mitchell, Oct. 1976, SPE 6058.

"New Drilling-Research Tool Shows What Happens Down Hole" Editor's Note, The Oil and Gas Journal, Jan. 8, 1968.

"Behavior of Multiple-Stabilizer Bottom-Hole Assemblies" by Keith Millheim, The Oil and Gas Journal, Jan. 1, 1979.

*Primary Examiner*—Stephen J. Novosad

*Assistant Examiner*—Bruce M. Kisliuk

[57] ABSTRACT

In the representative embodiments of the present invention described herein, new and improved methods and apparatus are disclosed for measuring various forces acting on an intermediate body between the lower end of a drill string and the earth-boring apparatus coupled thereto whereby the magnitudes and angular directions of bending moments and side forces acting on the earth-boring apparatus can be readily determined so that predictions can be made of the future course of excavation of the apparatus.

30 Claims, 4 Drawing Sheets

FIG.1
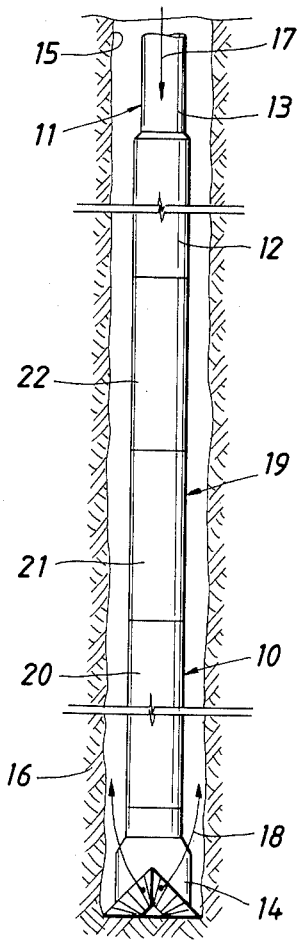
FIG.3
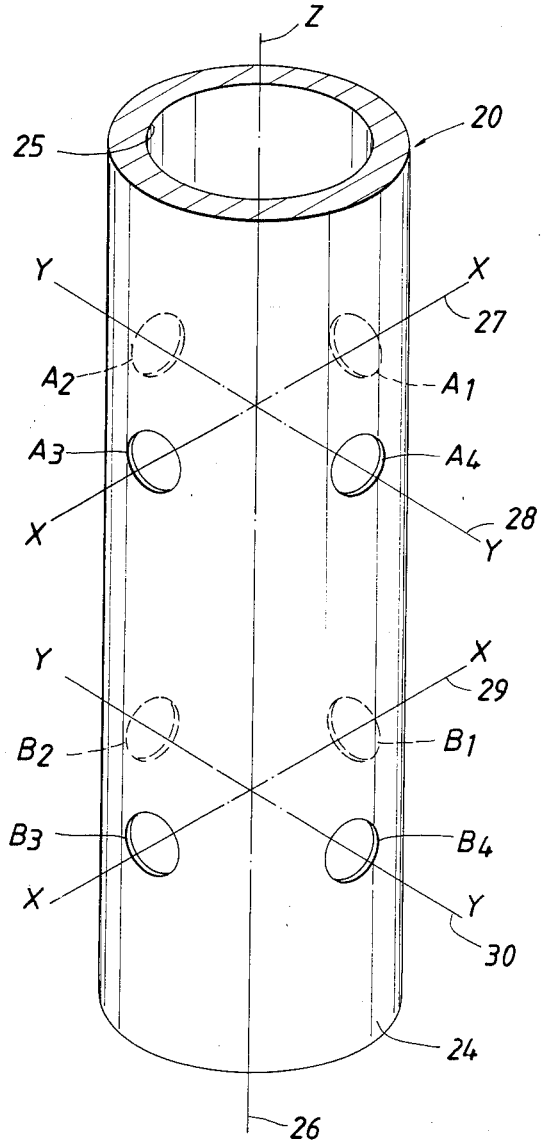
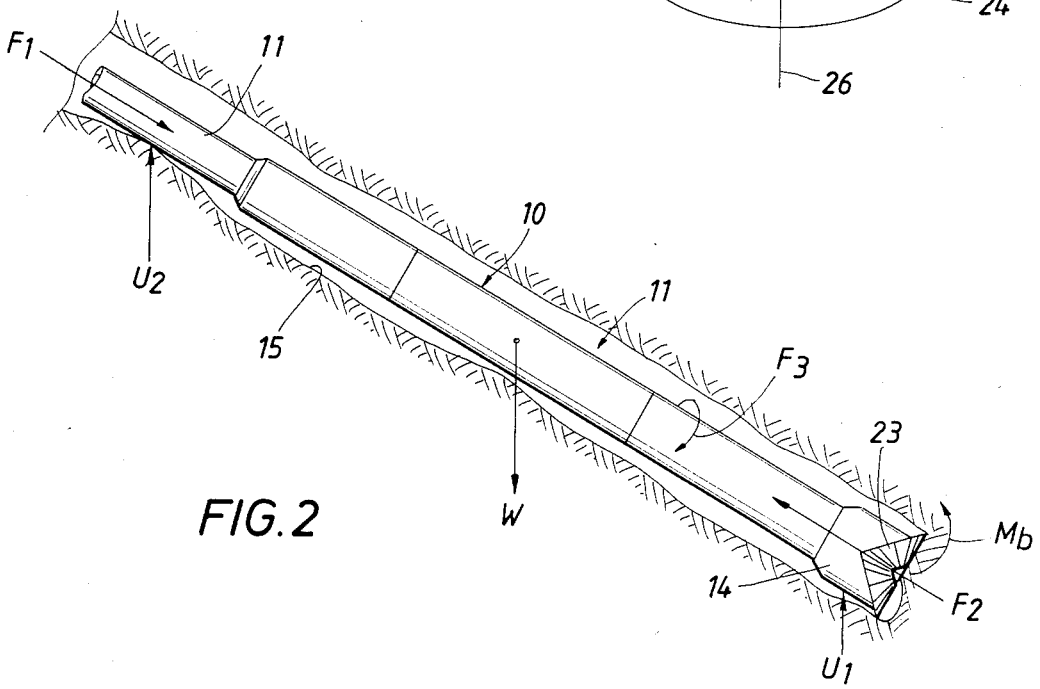
FIG.2

METHODS AND APPARATUS FOR CONTROLLED DIRECTIONAL DRILLING OF BOREHOLES

BACKGROUND OF THE INVENTION

In present-day drilling operations it is advantageous to have the capability of controlling the directional course of the drill bit as it progressively excavates a borehole. Such controlled directional drilling is particularly needed in any offshore operation where a number of wells are successively drilled from a central platform to individually reach various target areas that are respectively situated at different depths, azimuthal orientations and horizontal displacements from the drilling platform. It should, of course, be recognized that directional drilling is not limited to offshore operations alone since there are also many inland operations where the drill bit must be deliberately diverted in a desired lateral direction as the borehole is being drilled.

Heretofore most directional drilling operations were carried out by temporarily diverting the drill bit in a selected direction with the expectation being that the drill bit would thereafter continue to advance along a new course of excavation when normal drilling was resumed. For instance, in a typical whipstock operation, a special guide is temporarily positioned in a borehole to guide a reduced-size drill bit as it drills a short deviated pilot hole in a selected direction. The guide device is then removed and drilling is resumed with a full-size drill bit for reaming out the pilot hole and continuing along the new course of excavation established by the pilot hole. Similarly, in another common directional drilling technique, a so-called "big eye " drill bit is selectively oriented in a borehole to direct an enlarged port in the bit in a given lateral direction. Then, while rotation of the bit is temporarily discontinued, the mud pumps are operated for forcibly discharging a jet of drilling mud from the enlarged port to progressively carve out a cavity in the adjacent sidewall of the borehole into which the bit will hopefully advance whenever rotation is resumed. A third common directional drilling technique employs a fluid-driven motor and earth-boring device that are coupled to a so-called "bent sub" which can be cooperatively controlled from the surface for selectively positioning the device to drill along any one of several courses of excavation.

With these typical directional drilling techniques, it is necessary to make directional measurements from time to time so that appropriate and timely corrective actions can be taken whenever it appears that the drilling apparatus is not proceeding along a desired course of excavation. Nevertheless, when typical wireline measuring techniques are employed, the course of the drilling apparatus can not be determined without periodically interrupting the drilling operation each time a measuring tool is lowered into the drill string to obtain directional measurements. Thus, when wireline measuring techniques are being used, it must be decided whether to continue drilling a given borehole interval with a minimum of delays or to prolong the drilling operation by making frequent directional measurements to be certain that the drilling apparatus is maintaining a desired course of excavation.

With the advent of various measuring-while-drilling or so-called "MWD" tools such as those which are now commercially available, it became possible to transmit to the surface one or more directional measurements either separately or in conjunction with other real-time downhole measurements without having to interrupt the drilling operation. Generally these directional measurements are obtained by arranging a MWD tool to include typical directional instruments adapted to provide real-time measurements representative of the spatial position of the tool in a borehole. Alternatively, as described in U.S. Pat. No. 2,930,137 to Jan J. Arps, it has been proposed to arrange a typical MWD tool with special instrumentation for measuring the bending moments in a lower portion of the drill string to provide real-time measurements which are presumably representative of the crookedness or curvature of the borehole as it is being drilled.

Accordingly, when a conventional drill bit is combined with a MWD tool which can provide either or both of these realtime measurements, it can be determined whether at least limited downhole directional changes are being effected from the surface by varying one or more drilling parameters such as the rotational speed of the drill string, the flow rate of the drilling mud in the drill string and the load on the drill bit. The ability to make these real-time directional or bending-moment measurements has also made it feasible to combine either a big-eye bit or a drilling motor coupled to a controllable bent sub with a suitable MWD tool for continuously monitoring the directional drilling tool as it excavates a borehole. It should be noted in passing that it has been found advantageous to employ MWD tools capable of providing real-time directional measurements while drilling a deviated borehole or while drilling a borehole along a generally-vertical course of excavation.

Regardless of the type of drilling apparatus that is employed, the instrumentation section of a typical MWD tool is ordinarily separated from the drilling apparatus by various tool bodies and, in some instances, one or more drill collars as well. Accordingly, when a directional measurement is made, the drilling apparatus is already at an advanced location that the measuring instruments will not reach until perhaps several hours later. In other words, any particular directional measurement represents only the previous location of the drilling apparatus when it was drilling the borehole interval that is presently occupied by the directional instrumention in the MWD tool. Since the several interconnecting bodies and drill collars are relatively flexible, the drilling apparatus can be easily diverted from its intended course of excavation by such things as variations in formation properties or in the borehole environment or by changes in the performance characteristics of the drilling apparatus. Even when such factors are taken into account, it can not be realistically assumed that the drilling apparatus will always remain axially aligned with the instruments in the MWD tool. Thus, it must be recognized that these prior-art bending-moment and directional measurements can at best provide only an estimate of the probable location of the drilling apparatus at the time that a particular measurement was made. With so many variables, those skilled in the art will, of course, appreciate that these prior-art bendingmoment and directional measurements can not be reliably used for accurately determining the present position of the drilling apparatus much less predicting the future course of excavation of the drilling apparatus.

Accordingly, it was not until the invention of the new and improved methods and apparatus that are described in U.S. Pat. Nos. 4,303,994 and 4,479,564 to Denis R. Tanguy that it was considered possible to determine the position of the drilling apparatus with some degree of accuracy as well as to predict its future course of excavation. It will, of course, be recognized that the teachings of these two Tanguy patents can be useful for maintaining an earth-boring device on a particular course of excavation as well as for selectively redirecting the boring apparatus as necessary to reach a designated target area. Nevertheless, despite the advantages of employing the principles of the aforementioned Tanguy patents, there are situations in which the future course of excavation of earth-boring apparatus must be ascertained with more precision than would be possible by practicing the inventions disclosed in those patents.

OBJECTS OF THE INVENTION

Accordingly, it is an object of the present invention to provide new and improved methods and apparatus for determining the present course of excavation of earth-boring apparatus and reliably predicting its probable future course of excavation.

It is another object of the present invention to provide new and improved methods and apparatus for predicting the probable directional course of earth-boring apparatus excavating a borehole as well as for directing the apparatus as needed for thereafter advancing along a selected directional course.

It is a further object of the present invention to provide new and improved methods and apparatus for measuring various forces acting on an interconnecting body between the lower end of a drill string and earth-boring apparatus and combining these measurements to reliably predict the future course of the earth-boring apparatus with more accuracy than has heretofore been possible.

SUMMARY OF THE INVENTON

These and other objects of the present invention are attained in the practice of the new and improved methods that are disclosed herein by operating measuring apparatus dependently coupled to a drill string and carrying earth-boring apparatus for excavating a borehole. As the earth-boring apparatus is being operated to excavate the borehole, one or more measurements representative of the spatial position of the earth-boring apparatus are obtained and combined for providing an output signal indicative of the present directional course of the earth-boring apparatus. Then, as the earth-boring apparatus continues to excavate the borehole, one or more measurements representative of the bending moments and shear forces acting on the measuring apparatus are obtained and used for providing an output signal indicative of the magnitude and the angular direction of lateral forces tending to divert the earth-boring apparatus from its present directional course. Thereafter, these output signals are used for determining the present location of the earth-boring apparatus as well as predicting the subsequent directional course of the earth-boring apparatus.

While practicing the new and improved methods for predicting the subsequent directional course of the earth-boring apparatus, the objects of the present invention are further attained by utilizing these output signals for cooperatively directing the earth-boring apparatus along a selected course of excavation.

The objects of the present invention are further attained by providing new and improved measuring apparatus that is adapted to be coupled to earth-boring apparatus and suspended in a borehole from a drill string. To determine the present course of excavation of the earth-boring apparatus, the new and improved measuring apparatus of the present invention includes direction-measuring means for determining the present azimuthal direction and angular inclination of the earth-boring apparatus and producing one or more output signals representative of the spatial position of the boring apparatus. To determine whether extraneous forces are diverting the earth-boring apparatus from its present course of excavation, the measuring apparatus also includes force-measuring means for producing one or more output signals representative of the bending moments and shear forces acting on the measuring apparatus at a designated location above the earth-boring apparatus. The measuring apparatus further includes circuit means for combining these output signals to determine the magnitude and direction of any forces tending to divert the earth-boring apparatus. The measuring apparatus also includes means for cooperatively utilizing these output signals to direct the earth-boring apparatus along a selected course of excavation.

BRIEF DESCRIPTION OF THE DRAWINGS

The novel features of the present invention are set forth with particularity in the appended claims. The invention, together with further objects and advantages thereof, may be best understood by way of the following description of exemplary methods and apparatus employing the principles of the invention as illustrated in the accompanying drawings, in which:

FIG. 1 shows a preferred embodiment of a directional drilling tool arranged in accordance with the principles of the present invention as this new and improved tool may appear while practicing the methods of the invention as a borehole is being drilled along a selected course of excavation;

FIG. 2 is a simplified view showing various forces that may be imposed on the lower portion of a drill string;

FIG. 3 is an isometric view of a preferred embodiment of a body member for the new and improved force-measuring means of the invention showing a preferred arrangement of the body for supporting several force sensors on selected orthogonal measuring axes;

DETAILED DESCRIPTION OF THE INVENTION

Figure 4A:
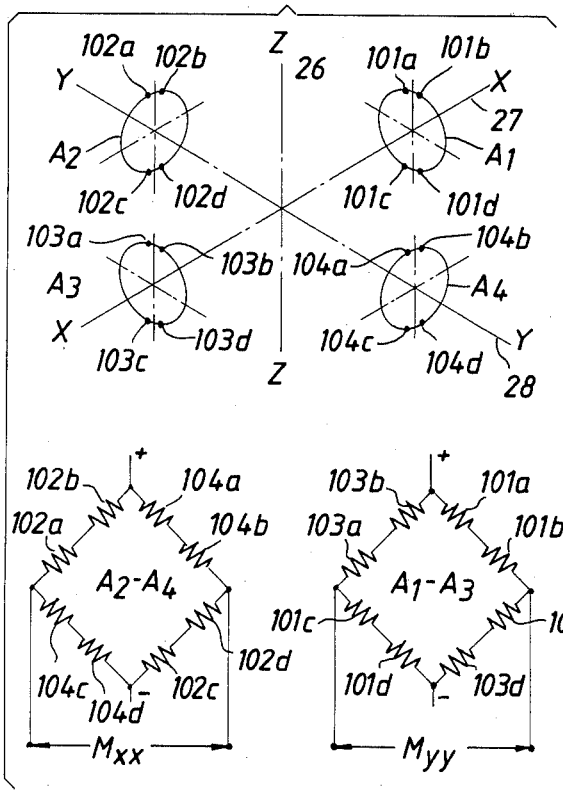
FIGS. 4A–4C are schematic representations of the body member shown in FIG. 3 respectively showing preferred locations for various sets of the force sensors for achieving maximum sensitivity as well as depicting a preferred arrangement of the bridge circuits employing these force sensors to obtain the respective measurements needed for practicing the present invention.

Turning now to FIG. 1, a preferred embodiment of a new and improved directional drilling tool 10 arranged in keeping with the principles of the present invention is shown dependently coupled to the lower end of a tubular drill string 11 comprised of one or more drill collars, as at 12, and a plurality of tandemly-connected joints of drill pipe as at 13. As depicted, the new and improved directional drilling tool 10 includes earth-boring means such as a fluid-powered turbodrill or a conventional drill bit as at 14 for excavating a borehole 15 through various earth formations as at 16. As is usual, once the drill bit 14 is lowered to the bottom of the borehole 15, the drill string 11 is rotated by a typical drilling rig (not shown) at the surface as substantial volumes of a suitable drilling fluid such as a so-called "drilling mud" are continuously pumped downwardly through the drill string (as shown by the arrow 17). The drilling mud is discharged from fluid ports in the drill bit 14 for cooling it as well as for carrying formation materials removed by the bit to the surface as the drilling mud returns upwardly (as shown by the arrow 18) by way of the annular space in the borehole 15 outside of the drill string 11.

As depicted in FIG. 1, the directional drilling tool 10 further comprises a typical MWD tool 19 which is preferably arranged with a plurality of heavy-walled tubular bodies which are tandemly coupled together to enclose new and improved force-measuring means 20 of the invention adapted for measuring various forces acting on the directional tool, typical position-measuring means 21 adapted for measuring one or more parameters indicative of the spatial position of the directional tool and typical datasignalling means 22 adapted for transmitting encoded acoustic signals to the surface through the downwardly-flowing mud stream in the drill string 11 that are representative of the output signals respectively provided by the force-measuring means and the position-measuring means. If desired, the MWD tool 19 may also include one or more additional sensors and circuitry (not shown) as are typically employed for measuring various downhole conditions such as electrical or radioactivity properties of the adjacent earth formations and the temperature of the drilling mud. The output signals representative of each of these several measurements will be sent to the surface by way of the data-transmiting means 22 where they will be detected and processed by appropriate surface appratus (not shown in the drawings). In the preferred embodiment of the directional drilling tool 10, the MWD tool 19 as well as the surface detecting-and-processing apparatus are respectively arranged in the same fashion as the downhole and surface apparatus disclosed in the aforementioned Tanguy patents which, along with the other patents described therein, are herein incorporated by reference. Although it is preferred to employ a MWD tool as described in the Tanguy patents, it will be realized that other telemetry systems such as those systems mentioned in the Tanguy patents could also be utilized for practicing the new and improved methods of the present invention.

Turning now to FIG. 2, a somewhat-simplified diagram is shown of the new and improved directional drilling tool 10, the lower portion of the drill string 11 above the tool and the drill bit 14 therebelow for schematically illustrating some of the forces which may be acting on this assembly during a typical drilling operation. Those skilled in the art will, of course, recognize that this diagram represents only one of an infinite number of situations where the several forces acting on such an assembly can effect changes in the course of the drill bit 14 as it excavates the borehole 15. In the exemplary situation seen in FIG. 2, there is a downward force, F1, which is essentially the overall weight of the drill string 11 that acts along the central longitudinal axis of the drill string and is opposed by an equal, but opposite, force, F2, acting upwardly on the drill bit 14. As the drill string 11 is rotated from the surface there will also be a torsional force, F3, imposed on the drill bit 14 while the borehole 15 is being excavated. Moreover, where the borehole 15 is inclined as depicted in FIG. 2, the overall weight, W, of any unsupported portions of the new and improved tool and the drill string will be downwardly directed and, as shown, will be opposed, for example, by upwardly-directed force components, U1 and U2, wherever the drilling tool 10, the drill string 11 or the drill bit 14 are in contact with the wall of the borehole 15. It will, of course, be recognized that even if the drill string 11 is substantially vertical, there can still be side forces, as at U1 and U2, when the drill string is deformed due to vertical loading or lateral instability.

It must be particularly noted that heretofore it has been erroneously assumed that the upwardly-directed force F2 imposed on the drill bit 14 is always equally distributed so that there will be a zero bending moment on the drill bit (e.g., see Col. 7, Lines 39 and 40 of the aforementioned Arps patent). It has, however, now been determined that even when the borehole is vertical, frequently only one or two of the cutting members or cones, as at 23, on a typical rotary bit will be in contact with the bottom of the borehole 15 so that often the upward force F2 will be eccentrically imposed on the drill bit and thereby create a significant bending moment, as depicted at Mb, that will divert the bit 14 laterally whenever one or more of the bit cones are not resting on the bottom of the borehole. Accordingly, as will be subsequently explained in greater detail, a significant aspect of the present invention is particularly directed toward providing new and improved methods and apparatus for accurately determining the magnitude and direction of the bending moment Mb acting on the drill bit 14 at any time during the course of a typical drilling operation. Then, as will also be subsequently explained, by using the principles of the present invention for determining the magnitude and direction of the overall diverting force, Fb, caused by such forces as F1 and W which collectively tend to divert the drill bit 14 laterally, an accurate prediction may be made of the future course of the drill bit as it continues excavating the borehole 15.

Turning now to FIG. 3, the external body 24 of the new and improved force-measuring means 20 is depicted somewhat schematically to illustrate the spatial relationships of the several measurement axes of the body as the force-measuring means measure various dynamic forces acting on the directional drilling tool 10 during a typical drilling operation. Rather than making the force-measuring means 20 an integral portion of the drilling tool 10, in the preferred embodiment of the force-measuring means the thick-walled tubular body 24 is cooperatively arranged as a separate sub that can be mounted just above the drill bit 14 for obtaining more accurate measurements of the various forces acting on the bit. It will, of course, be appreciated that other types of housings such as, for example, those shown in U.S. Pat. Nos. 3,855,857 or 4,359,898 could be used as depicted there or with modifications as needed for devising alternative embodiments of force-measuring apparatus also falling within the scope of the present invention.

As seen in FIG. 3, the body 24 has a longitudinal or axial bore 25 of an appropriate diameter for carrying the stream of drilling mud flowing through the drill string 11. The body 24 has an upper set of four lateral or radial openings, as at A1, A2, A3 and A4, which are spaced equally around the circumference of the tubular body with the central axes of these openings lying in a common transverse plane that perpendicularly intersects the longitudinal or central Z-axis 26 of the body. In a similar fashion, the body 24 is also provided with a lower set of radial openings, as at B1, B2, B3 and B4, respectively disposed directly below their counterparts in the upper set of openings, A1-A4, and having their axes all lying in a lower transverse plane that is parallel to the upper transverse plane and also perpendicularly intersects the longitudinal Z-axis 26 of the body. It will, of course, be recognized that in the depicted arrangement of the body 24 of the force-measuring means 20, these openings are cooperatively positioned so that they are respectively aligned with one another in either an upper or a lower transverse plane that perpendicularly intersects the Z-axis 26 of the body. For example, as illustrated, one pair of the upper holes, A1 and A3, are respectively located on opposite sides of the body 24 and axially aligned with each other so that their respective central axes lie in the upper transverse plane and together define an X-axis 27 that is perpendicular to the Z-axis 26 of the body. In like fashion, the other two openings A2 and A4 in the upper plane are located on diametrically-opposite sides of the body 24 and are angularly offset by 90-degrees from the first set of openings A1 and A3 so that their aligned central axes respectively define the Y-axis 28 in the upper plane, with this upper Y-axis being perpendicular to the Z-axis 26 as well as the upper X-axis 27.

In a similar fashion, one opposed pair of the openings B1 and B3 is arranged to define the X-axis 29 in the lower plane and the other opposed pair of openings B2 and B4 are arranged to define the Y-axis 30 in the lower plane. As previously noted, the upper openings A1 and A3 are positioned directly over their counterpart lower openings B1 and B3 so that the upper X-axis Z7 is parallel to the lower X-axis 29 and thereby define a vertical plane including the Z-axis 26. Likewise, the upper openings A2 and A4 are located above the counterpart openings B2 and B4 so that the upper and lower Y-axes 28 and 30 define another vertical plane including the Z-axis 26 that will be perpendicular to the vertical plane including the X-axes 27 and 29.

Turning now to FIG. 4A, an isometric view is shown of the upper openings A1–A4, the upper X-axis 27, the upper Y-axis 28 and the Z-axis 26 to illustrate the orthogonal relationship of the several axes of the body 24. As will be explained later in greater detail, force-sensing means (such as a coordinated set of resistance-type strain gauges) are respectively mounted at the top and bottom of each opening (i.e., at the 12 o'clock or the 0degrees angular position in the opening itself as well as at the 6 o'clock or 180-degrees angular position within these opening) and electrically connected for respectively defining the several legs of typical Wheatstone bridge networks. For example, as depicted in FIG. 4A, to provide one bridge circuit A1–A3, a first pair of matched gauges **101*a* and 101*b* are respectively mounted in the 0-degrees position of the opening A1 and a second matched pair of gauges 101*c* and 101*d* are mounted in the 180-degrees position of the same opening A1. In a like fashion, a first matched pair of gauges 103*a* and 103*b* are mounted side-by-side at the top of the opening A3 and a second matched pair of gauges 103*c* and 103*d*** are mounted side-by-side at the bottom or 180-degrees position of the opening A3.

As also shown in FIG. 4A, another bridge circuit A2–A4 is provided by cooperatively mounting a corresponding set of force-sensing gauges **102*a*–102*d* and 104*a*–104*d*** in the diametrically opposed openings A2 and A4. Those skilled in the art will, of course, recognize that although it is preferred to arrange the bridges A1–A3 and A2–A4 with matched pairs of gauges at each of the upper and lower positions in an opening either to minimize or eliminate the effects of secondary or extraneous forces, a single gauge could be alternatively arranged in each of these positions without departing from the scope of the present invention.

In the practice of the invention, the new and improved force-measuring means 20 of the present invention, the bridges A1–A3 and A2–A4 are each cooperatively arranged as depicted in FIG. 4A so that when a bending moment acting on the body 24 produces tension in that side of the body in which the opening A2 is located, the Wheatstone bridge A1–A3 will produce an output signal representative of what will hereafter be characterized as a positive bending moment about the X-axis 27 (i.e., +Moment X-X). Conversely, when a bending moment is acting on the body 24 so as to instead produce tension in the other side of the body where the opening A4 is located, the bridge circuit A1–A3 will then produce a negative output signal showing that there is a negative bending moment (−Moment Y-Y) acting on the body. In a similar fashion, the bridge circuit A2–A4 functions to produce a positive output signal (i.e. +Moment Y-Y) when the side of the body 24 containing the opening A1 is in tension and a negative output signal (i.e., −Moment Y-Y) when the opposite side of the body containing the opening A3 is located is in tension. The utilization of these respective signals, Moment X-X and Moment Y-Y, will be discussed subsequently.

Figure 4B:
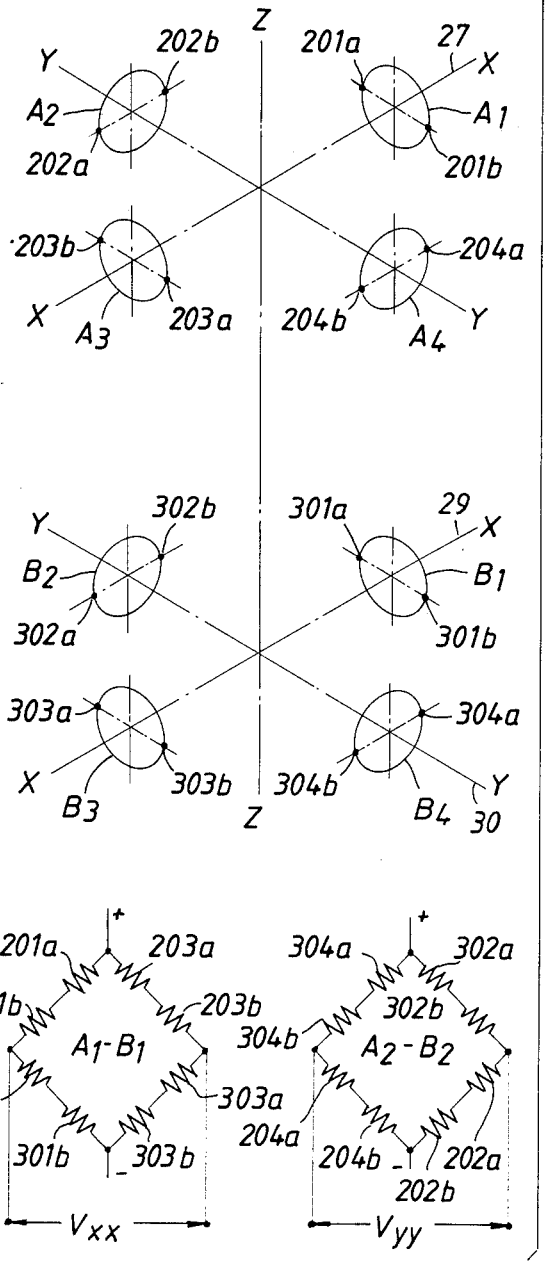

Turning now to FIG. 4B, an isometric view similar to FIG. 4A is shown, but in this view both the upper openings A1–A4 and the lower openings B1–B4 are depicted. As previously discussed, the aligned central axes of the upper openings A1 and A3 together define the upper X-axis 27 and the central axes of the lower openings B1 and B3 cooperate to define the lower X-axis 29, with these two X-axes together with the Z-axis cooperatively defining a longitudinal X-Z plane including the X-axes and the Z-axis 26. In like fashion, the aligned central axes of the two upper openings A2 and A4 define the upper Y-axis 28 and the axes of the two lower openings B2 and B4 define the lower Y-axis 30, with these upper and lower Y-axes together with the Z-axis 26 respectively defining a longitudinal Y-Z plane perpendicular to the longitudinal X-Z plane defined by the upper and lower X-axes.

As depicted in FIG. 4B, force-sensing means are cooperatively arranged in each of the openings A1–A4 and B1–4 for detecting laterally-directed shear forces acting on the body 24 of the new and improved force-measuring means 20. Although such shear forces could be detected with only a single sensor in each of the openings A1–A4 and B1–B4, in the practice of the present invention it is instead preferred to position a single force sensor on each side of each opening. Moreover, as illustrated, it has been found that the optimum sensitivity is attained by mounting these force sensors so that for any given opening one of the associated sensors is at the 3 o'clock or 90-degrees angular position in the opening and the other associated sensor in that opening is at the 9 o'clock or 270-degrees angular position. By comparing the locations of the several sensors as shown in the schematic drawing of the body 24 with the bridge circuits in the lower portion of FIG. 4B, it will be noted that the several force sensors are cooperatively located to respond only to laterally-directed shear forces acting in a given one of the two above-mentioned transverse planes. For example, one leg of the bridge circuit A1–B1 includes the force sensors 201*a* and 201*b* in the upper opening A1 and its associated leg is comprised of the force sensors 301*a* and 301*b* mounted on opposite sides of the lower opening B1. The other leg of the bridge circuit A1–B1 is similarly comprised of the force sensors 203*a* and 203*b* mounted within the upper opening A3 and the sensors 303*a* and 303*b* that are mounted on opposite sides of the lower opening B3. With the above-identified sensors mounted as depicted, the bridge circuit A1–B1 will, therefore, produce an output signal (i.e., Shear X-X) representative of the lateral shear forces acting in the X-Z plane of the tool body 24. Conversely, the bridge circuit A2–B2 will be effective for measuring the lateral shear forces acting in the Y-Z plane of the body 24 and producing a corresponding output signal (i.e., Shear Y-Y).

Figure 4C:
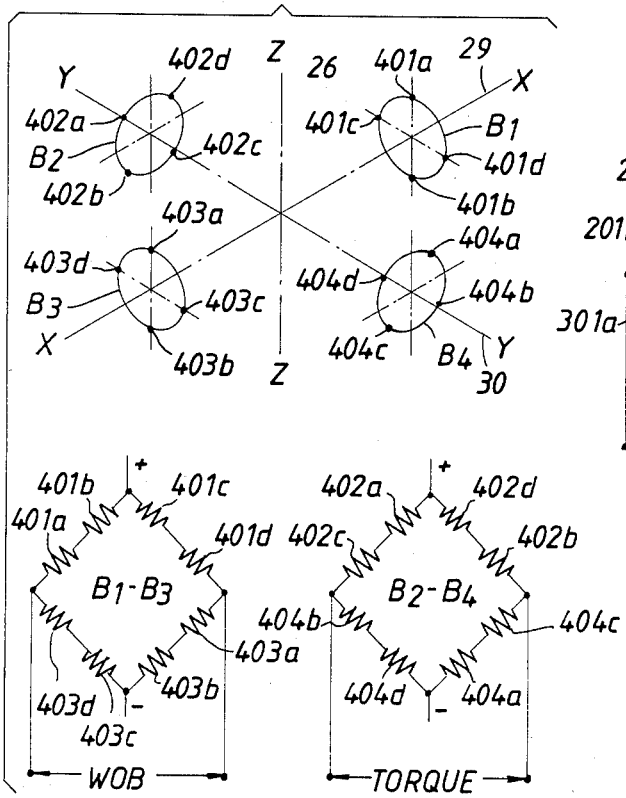

Turning now to FIG. 4C, an isometric view is shown of the lower openings B1–B4, the lower X-axis 29, the lower Y-axis 30 and the Z-axis 26. As depicted, to measure the longitudinal force acting downwardly on the body member 24, force-sensing means are mounted in each quadrant of the lower openings B1 and B2. To achieve maximum sensitivity, these force-sensing means (such as typical strain gauges 401–401*d* and 403*a*–403*d*) are respectively mounted at the 0-degrees, 90-degrees, 180-degrees and 270-degrees positions within the lower openings B1 and B3. In a like fashion, to measure the rotational torque imposed on the body member 24, additional force-sensing means, such as typical strain gauges 402*a*–402*d* and 404*a*–404*d*, are mounted in each quadrant of the lower openings B2 and B4. As depicted, it has been found that maximum sensitivity is provided by mounting the strain gauges 402*a*–404*d* at the 45-degrees, 135-degrees, 225-degrees and 315-degrees positions in the lower opening B2 and by mounting the other strain gauges 404*a*–404*d* at the same angular positions in the lower opening B4. Measurement of the weight-on-bit is, therefore, obtained by arranging the several strain gauges 401*a*–401*d* and 403*a*–403*d* in a typical Wheatstone bridge B1–B3 to provide corresponding output signals (i.e., WOB). In a like manner, the torque measurements are obtained by connecting the several gauges 402*a*–402*d* and 404*a*–404*d* into another bridge B2–B4 that produces corresponding output signals (i.e., Torque).

Figure 5:
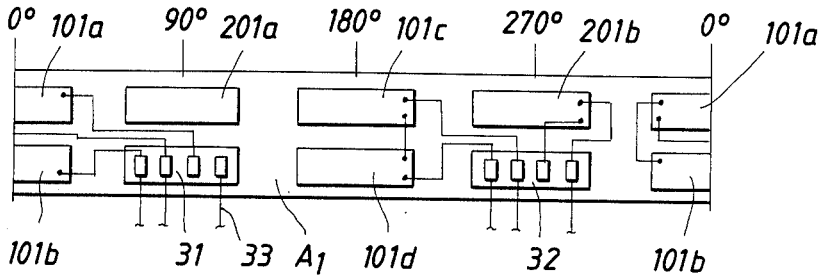
FIG. 5 is an enlarged view of one portion of the force-measuring means shown in FIG. 3 illustrating in detail a preferred mounting arrangement for the force sensors of the new and improved force-measuring means.

Those skilled in the art will, of course, appreciate that the several sensors described by reference to FIGS. 4A–4C can be mounted in various arrangements on the body 24. However, in the practice of the present invention it has been found most advantageous to mount the several force sensors in the four upper openings A1–A4 and in the lower openings B1–B4 in such a manner that although the force sensors in a given opening are separated from one another, each sensor is located in an optimum position for providing the best possible response. Accordingly, as will be apparent by comparing FIGS. 4A–4C with one another, the several sensors are all positioned so as to not interfere with one another and to maximize the output signals from each sensor. For example, as depicted in the developed view of the upper opening A1 seen in FIG. 5, the shear sensors 201*a* and 201*b* are each mounted at their respective optimum locations in the same openings as are the bending moment sensors 101*a* –101*d*. It will, of course, be recognized that the several sensors located in the upper opening A1 are each secured to the body 24 in a typical manner such as with a suitable adhesive. As illustrated, in the preferred arrangement of the force-measuring means 20 it has also been found advantageous to mount one or more terminal strips, as at 31 and 32, in each of the several openings to facilitate the interconnection of the force sensors in any given opening to one another as well as to provide a convenient terminal that will facilitate connecting the sensors to various conductors, as at 33, leading to the measuring circuitry in the MWD tool 19 (not seen in FIG. 5).

As is typical, it is preferred that the several force sensors be protected from the borehole fluids and the extreme pressures and temperatures normally encountered in boreholes by sealing the sensors within their respective openings A1–A4 and B1–84 by means of typical fluid-tight closure members (not shown in the drawings). The enclosed spaces defined in these openings and their associated interconnecting wire passages are usually filled with a suitable oil that is maintained at an elevated pressure by means such as a piston or other typical pressure-compensating member that is responsive to borehole conditions. Standard feed-through connectors (not shown in the drawings) are arranged as needed for interconnecting the conductors in these sealed space with their corresponding conductors outside of the oil-filled spaces.

Turning now to the principles of operation for the new and improved force-measuring means 20 of the present invention. As discussed above, it has been erroneously assumed heretofore that since the earth-boring apparatus such as the drill bit 14 is supported on the bottom of the borehole, as at 15, there are no significant bending moments acting upwardly on the earth-boring apparatus which would be effective for diverting the apparatus from its present directional course. Thus, on the basis of this invalid assumption, it has been generally presumed that if there are any lateral forces tending to divert the earth-boring device, whatever bending moments that are acting at that time on the lower portion of the drill string will be a direct function of these forces. Accordingly, the accepted practice heretofore for determining whether the earth-boring apparatus is being diverted from its present directional course has been to simply measure the bending moments acting at one or more locations in the lower portion of a drill string and compute the magnitude and direction of any diverting force from these measurements alone. It has, nevertheless, been found that ordinarily there are significant bending moments which, as depicted at Mb in FIG. 2, are acting upwardly on the earth-boring apparatus; and, as a result, these bending moments Mb must be taken into account for accurately computing the total magnitudes and angular directions of any lateral forces Fb that are tending to divert the earth-boring apparatus from its present course of excavation during a typical drilling operation.

Accordingly, to practice the new and improved methods of the invention, the tool body 24 of the force-measuring means 20 is coupled at a predetermined location in the drill string 11 above the drill bit 14 so that it can be successively operated to obtain a plurality of independent force measurements at that location at selected time intervals during a drilling operation. One group of these force measurements that are made at a given time is used for determining the magnitude and the absolute angular direction of the total bending moment, Mo, that is then acting on the drill string 11 at that location above the drill bit 14.

Another group of these force measurements is uniquely used for determining the magnitude and the absolute angular direction of the laterally-directed shear force, Fo, acting at the same given time on the drill string 11 at the level of the body 24.

By combining the lateral (shear) force $F_o$ and the bending moment $M_o$ that are found to be acting on the body 24 at this given time with a predetermined conversion factor or so-called "transfer function" which is mathematically representative of the elastic characteristics of one or more bodies connecting the drill bit 14 to the body 24, a determination may be made of the magnitude of the corresponding lateral (shear) force, $F_b$, and the corresponding bending moment, $M_b$, that is tending to divert the drill bit 14 away from its course of excavation. Then, by combining the computed absolute direction of the lateral force Fb that is acting on the drill bit 14 with measurements which are representative of the spatial position and directional course of the bit in the borehole 15, the true direction or heading of the drill bit can be accurately established. At the same time, an analysis of the computed bending moment Mb that is acting on the drill bit 14 will indicate whether the bit is advancing upwardly or downwardly as well as provide at least a general idea of the rate of ascent or descent of the drill bit as it continues to excavate the borehole 15. Accordingly, by periodically obtaining these two groups of independent force measurements during the course of a typical drilling operation with the new and improved apparatus of the invention and utilizing these measurements in accordance with the methods of the invention, the future course of the drill bit 14 can be accurately predicted.

As previously discussed by reference to FIG. 4A, to determine the magnitude of the bending moment Mo that is acting at a selected measuring point in the body 24 that is coupled in the drill string 11 at a selected distance above the drill bit 14, one group of independent measurements are respectively made along the X and Y orthogonal measurement axes which originate at the Z-axis 26 of the body 24. One series of these measurements involves independently measuring the bending moment acting on the body 24 along the longitudinal plane defined by the X-axis 27 and the Z-axis 26 of the body (i.e., Moment X-X as provided by the output signals of the bridge circuit A2–A4). Another series of these independent measurements is made to measure the bending moment acting on the body 24 along the Y-Z longitudinal plane of the body (i.e., the output signals Moment Y-Y provided by the bridge circuit A1–A3).

Inasmuch as these individual bending moments are each respectively related to their own measurement axis, the overall resultant bending moment Mo acitng on the body 24 is determined by computing the square root of the summation of the square of Moment X-X and the square of Moment Y-Y. The absolute angular direction of this resultant bending moment Mo is then determined by algebraically dividing the absolute value of the Moment Y-Y by the absolute value of the Moment X-X to compute the trigonometric tangent of the angle betwen the X-axis and the resultant bending moment Mo. It will, of course, be recognized that by observing the algebraic signs of the absolute values of these individual bending moments, Moment X-X and Moment Y-Y, it can be readily determined in which of the four quadrants the resultant bending moment Mo is lying. Accordingly, once the absolute angle has been computed from the tangent, an appropriate correction can be made to the computed angle to determine the true direction of the resultant moment. For example, if the absolute values of Moment X-X and Moment Y-Y ar both positive, it will be apparent that the resultant bending moment Mo must be in the first quadrant and the angle in which the resultant moment is directed is simply the arctangent of Moment X-X divided by Moment Y-Y. In the same way, when Moment X-X is negative and Moment Y-Y is positive, it is known that the resultant bending moment Mo lies in the second quadrant and is directed at a true angle of 180-degrees less the arctangent of the computed valued of Moment Y-Y divided by Moment X-X. Likewise, when both Moment X-X and Moment Y-Y are negative, the resultant bending moment Mo will be directed in the third quadrant at a true angle of 180-degrees plus the arctangent of Moment Y-Y divided by Moment X-X. On the other hand, when Moment X-X is positive and Moment Y-Y is negative, the resultant bending moment Mo must lie in the fourth quadrant and its true angular direction will be 360-degrees less the arctangent of the computed value of Moment Y-Y divided by Moment X-X.

As depicted in FIG. 4B, the previously mentioned other group of independent strain measurements are obtained for determining the lateral or shear force Fo acting transversely on the body 24. In the practice of the present invention, the force Fo is iniquely determined by measuring the bending moments acting at longitudinally-spaced upper and lower measuring points on the body 24 and, by means of a bridge circuit formed of these force sensors, combining these force measurements so as to directly measure the differential bending moments betwen the upper and lower measuring points in each orthogonal axis of the tool body 24. These differential measurements are then uniquely utilized for accurately determining the shear force Fo acting laterally on the body 24. Thus, as discussed above with respect to FIG. 4B, one series of these strain measurements (eg., Shear X-X) is made by simultaneously measuring the forces (i.e., the tension forces or the compression forces) which are acting at longitudinally-spaced upper and lower positions on opposite sides of the body 24 for determining the longitudinal forces acting in the X-Z plane of the body (i.e., the forces measured in the openings A1 and B1 are combined with the forces measured in the diametrically-opposite openings A3 and B3). At the same time, another series of these measurements (e.g., Shear Y-Y) is made in the the upper and lower openings A2 and B2 and in their respective diametrically-opposite openings A4 and B4 to determine the longitudinal forces simultaneously acting in the Y-Z plane of the body 24.

Particular attention should be given to the advantages of measuring the above-described shear forces in the manner that is schematically depicted in FIG. 4B. A force analysis will, of course, show that the strain gauges in any give one of the openings are actually measuring the stain due to the bending moment in that section of the body 24. For example, the gauges 201*a* and 201*b* mounted on the opposite sides of the upper opening A1 measure the bending moment on that side of the body 24 at the level of the upper openings; and the gauges 301*a* and 301*b* mounted on opposite sides of the lower opening B1 that is directly below the opening A1 are simultaneously measuring the bending moments acting at the lower level and on the same side of the body. By cooperatively combining the gauges 201*a* and 201*b* with the gauges 301*a* and 301*b* as illustrated in FIG. 4B to comprise two legs on one side of the bridge circuit A1–B1, together these two legs will uniquely cooperate for providing an overall measurement that is representative of the differential of bending moment on that side of the body 24. Those skilled in the art will realize that since the forces that are being measured at each of the upper and lowwer openings are quite substantial, if each force is separately measured and these separate measurements are used to compute the overall differential between the forces, even normal deviational errors in the individual measurements would greatly affect the accuracy of any differential that is subsequently computed from those measurements. Thus, in practicing the new and improved methods of the present invention, potential deviational errors are simply avoided by utilizing the depicted unique arrangement of the bridge circuit A1–B1 to directly compute the differential between the bending moments respectively acting at the levels of the upper and lower openings A1 and B1 on that side of the body 24.

The strain gauges 203*a* and 203*b* are similarly mounted in the upper opening A3 and cooperatively connected to the gauges 303*a* and 303*b* in the lower opening B3 therebelow as illustrated in FIG. 4B to form the two legs on the other side of the bridge circuit A1–B1 for directly measuring the differenital bending moment on the opposite side of the body between the openings A3 and B3. Accordingly, by combining these eight strain gauges to form the bridge circuit A1–B1 depicted in FIG. 4B, it will be recognized that the output signals from the bridge circuit (i.e., Shear X-X) will be representative of the overall differential, Mx, between the bending moments acting at longitudinally-spaced locations in the X-Z plane of the body 24. Since the vertical spacing between the upper and lower openings A1–A4 and B1–B4 is a known constant, the output signals of the bridge A1–B1, i.e., Shear X-X, which are representative of this overall differential bending moment Mx can be expressed by the following equation:

$$\Delta Mx = Fy * \Delta Z \qquad \text{Eq. 1}$$

where,

Fy = shear or side force acting along the Y-axis 28

ΔZ = longitudinal spacing between upper and lower openings (eg., between A1 and B1)

The same analysis can, of course, be applied to the output signals from the bridge circuit A2–B2 for determining the lateral force Fx acting along the upper X-axis 27 of the body 24. In a similar fashion, therefore, the net output of this other bridge circuit A2–B2 (i.e., Shear Y-Y) will be representative of the overall differential bending moment, ΔMy, between the spaced upper and lower locations in the Y-Z plane of the tool body 24. This overall differential ΔMy can, therefore, be expressed by the following equation:

$$\Delta My = Fx * \Delta Z \qquad \text{Eq. 2}$$

where,

Fx = shear or side force acting along the X-axis 27

ΔZ = longitudinal spacing between upper and lower openings (eg., between A2 and B2)

Since each of these lateral forces, Fx and Fy, is related to only its own particular orthogonal axis, it will be appreciated that the overall resultant or side force, Fo, acting laterally on the body 24 will lie in the upper transverse plane that passes throught the upper openings A1–A4. The magnitude of this resultant side force Fo can, of course, be determined from the basic Pythagorean equation as was done in the computation of the bending moment Mo. Likewise, the angular direction of the resultant force Fo is determined by algebraically dividing the absolute value of the force Fy by the absolute value of the force Fx to compute the trigonometric tangent of the angle between the X-axis 27 and the resultant force Fo. As was the case with the determination of the true direction of the bending moment Mo, the algebraic signs of the absolute values of these forces Fx and Fy will also determine which quadrant the resultant force Fo is in. Once the absolute angle is computed, the angular direction of the resultant force Fo is determined in the same manner as described above with reference to the computation of the angular direction of the bending moment Mo.

Once the bending moment Mo and the side force Fo have been determined, they must be used with the above-mentioned transfer function to determined the corresponding bending moment Mb and the side force Fb that are concurrently imposed on the drill bit 14. As previously described, the transfer function is a mathematical conversion factor which takes into account the elastic characteristics of the one or more bodies coupling the drill bit 14 to the tool body 24. The transfer function must therefore be computed for each particular configuration of drill collars, stabilizers, tool bodies, or whatever is included in the drill string that may affect the directional course of the boring apparatus such as the drill bit 14.

The first thing that must be done in determining the transfer function is to establish a mathematical model of whatever combination of tool bodies and the like that will be used to couple a give earth-boring device such as the drill bit 14 to the tool body 24. By means of traditional structural analysis techniques, the mathematical model is utilized to compute four so-called "influence coefficients" C1–C4 as follows:

C1 = bending moment imposed on body 24 in response to a bending moment of known magnitude acting on drill bit 14

C2 = bending moment imposed on body 24 in response to a lateral force of known magnitude acting on drill bit 14

C3 = bending moment imposed on body 24 in response to a bending moment of known magnitude acting on drill bit 14

C4=bending moment imposed on body 24 in response to a lateral force of known magnitude acting on drill bit 14

To compute the transfer function, the weight (i.e., W as shown in FIG. 2) of the one or more bodies between the drill bit 14 and the tool body 24 must also be considered whenever the directional drilling tool 10 is not vertical. In other words, whenever the directional drilling tool 10 is vertical, the weight W does not contribute to either the bending moment Mo or the lateral force Fo. On the other hand, if the drilling tool 10 is inclined as depicted in FIG. 2, the component of the distributed weight W which affects the bending moment Mo and lateral force Fo is that side of the force triangle that is perpendicular to the longitudinal axis of the tool. Once the angle of inclination of the directional drilling tool 10 is measured, this force is, of course, readily determined by means of conventional trigonometric computations where W is the hypotenuse of the force triangle. These computations will, therefore, provide two other factors to be considered in calculating the transfer function, with these factors being as follows:

Mw=bending moment imposed on body 24 by the component of the weight of those bodies connecting body 24 to drill bit 14 that is acting perpendicularly to the longitudinal axis of those bodies Fw=lateral force imposed on body 24 by the component of the weight of those bodies connecting body 24 to drill bit 14 that is acting perpendicularly to the longitudinal axis of those bodies The computed values of the coefficients and the weight factors are then respectively substituted in the following equations:

$$Mo = Mb * C1 + C2 * Fb + Mw \qquad \text{Eq. 3}$$

$$Fo = Mb * C3 + C4 * Fb + Fw \qquad \text{Eq. 4}$$

and solved by the following matrix equation:

$$\begin{Bmatrix} Mo \\ Fo \end{Bmatrix} = \begin{vmatrix} C1 & C2 \\ C3 & C4 \end{vmatrix} \begin{Bmatrix} Mb \\ Fb \end{Bmatrix} + \begin{Bmatrix} Mw \\ Fw \end{Bmatrix} \qquad \text{Eq. 5}$$

If this 2×2 matrix of the four coefficients C1–C4 is arbitrarily designated by "L", the above-mentioned transfer function is the inverse of this matrix L. This transfer function is arbitrarily designated by "H" and Equation 9 is then rewritten as follows:

$$\begin{Bmatrix} Mb \\ Fb \end{Bmatrix} = H\left[\begin{Bmatrix} Mo \\ Fo \end{Bmatrix} - \begin{Bmatrix} Mw \\ Fw \end{Bmatrix}\right] \qquad \text{Eq. 6}$$

Figure 6:
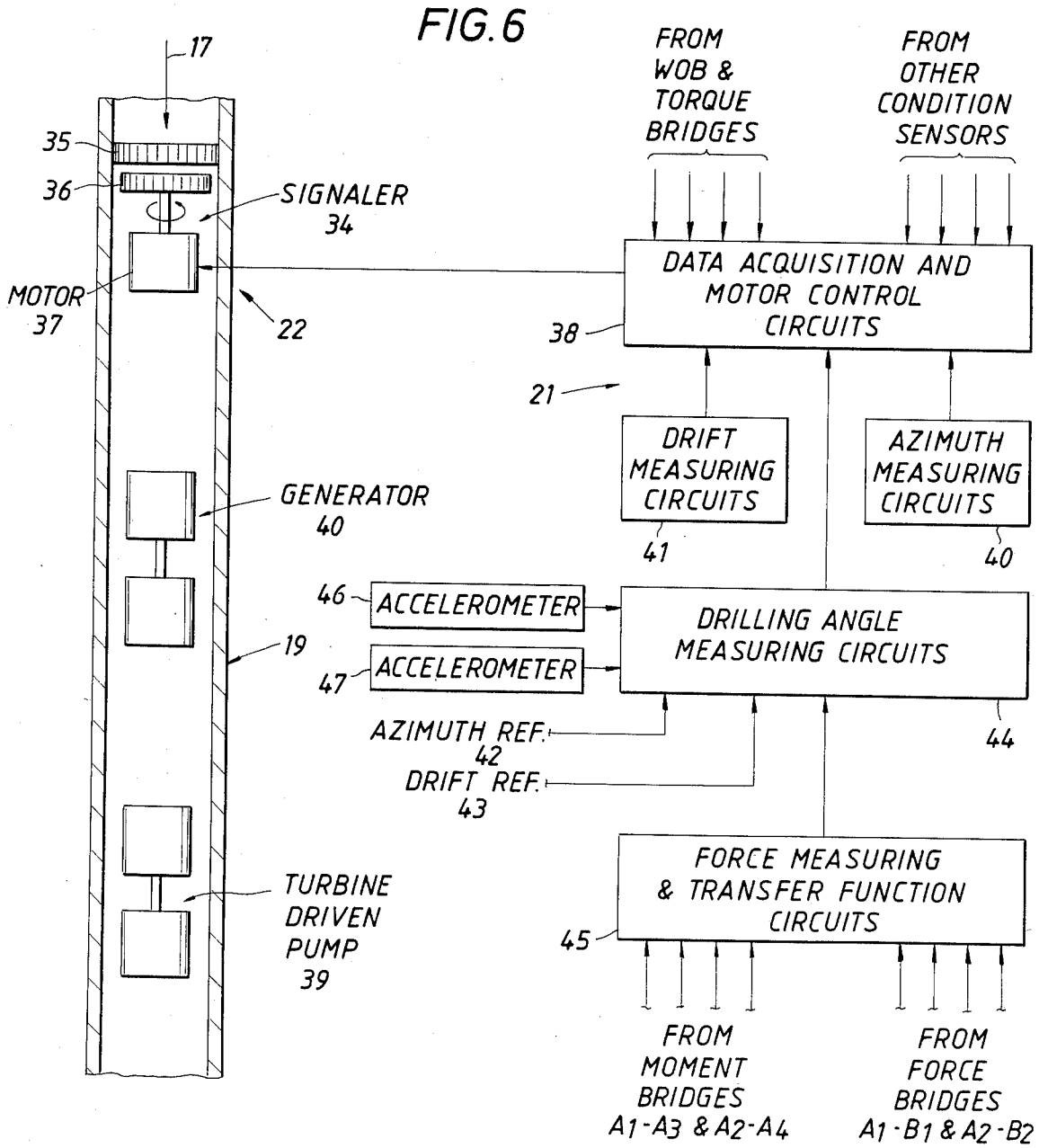
FIG. 6 depicts a preferred embodiment of downhole circuitry and components that may be utilized in conjunction with an otherwise-typical MWD tool for transmitting the output signals of the force-measuring means of the invention to the surface.

It is, of course, the principal object of the present invention to employ the new and improved methods and apparatus as described above for predicting the probable future directional course of the earth-boring apparatus, such as the drill bit 14, that is coupled to the directional tool 10; and, as far as is possible with the particular type of earth-boring apparatus being used, selectively directing the further advancement of the earth-boring apparatus along a desired course of excavation. Thus, to accomplish this principal object of the invention, the MWD tool 19 is preferably arranged as schematically depicted in FIG. 6. As illustrated there, the data-transmitting means 22 preferably include an acoustic signaler 34 such as one of those described, for example, in U.S. Pat. Nos. 3,309,565 and 3,764,970 which is arranged to transmit either frequency-modulated or phase-encoded data signals to the surface by way the downwardly-flowing mud stream 17. As fully described in those and many other related patents, the signaler 34 includes a fixed multi-bladed stator 35 that is operatively associated with a rotating multi-bladed rotor 36 for producing acoustic signals of the desired character. The rotor 36 is rotatably driven by means such as a typical hydraulic motor 37 that is operatively controlled by suitable motor-control circuitry as at 38.

The data-transmitting means 22 also include a typical turbine-powered hydraulic pump 39 which is driven by the mud stream 17 for supplying the hydraulic fluid to the motor 37 as well as for driving a motor-driven generator 40 that supplies power to the several electrical components of the MWD tool 19. The output signals from the WOB bridge circuit B1–B3 and from the Torque bridge circuit B2–B4 are coupled to the data-aquisition and motor-control circuitry 38 for driving the acoustic signaler motor 37 as needed for transmitting data signals to the surface which are representative of those several measurements. It will also be recognized that other condition-measuring devices (not shown) included in the MWD tool 19 may also be coupled to the circuitry 38 for transmitting data signals to the surface which are representative of those measured conditions.

To achieve the objects of the present invention, the position-measuring means 21 of the directional drilling tool 10 must be cooperatively arranged to provide output signals which are representative of the spatial position of the tool in the borehole 15. In the preferred manner of accomplishing this, the position-measuring means 21 include means such as a typical triaxial magnetometer 40 that is cooperatively arranged to provide electrical output signals representative of the angular position of the directional drilling tool 10 in relation to a fixed, known reference such as the global magnetic north pole. The position-measuring means 21 also include a typical tri-axial accelerometer 41 cooperatively arranged for providing electrical output signals representative of the angle of inclination of the directional drilling tool 10 from the vertical. The output signals from the accelerometer 41 could, of course, be used to provide alternative reference signals indicative of the angular position of the tool 10 in relation to a fixed, known reference to true vertical.

The various sensors which respectively comprise the magnetometer 40 and the accelerometer 41 are cooperatively mounted either as depicted in the previously-mentioned Tanguy patent or in diametrically-opposed enclosed chambers arranged at convenient locations on one of the tool bodies such as the tool body 24. The output signals of these position-measuring sensors 40 and 41 are respectively correlated with appropriate reference signals, as at 42 and 43, and combined by typical measurement circuitry, as at 44, to provide input signals to the data-acquisition and motor-control circuitry 44 representative of the azimuthal position and the angle of inclination of the directional drilling tool 10 in the borehole 15.

From the previous descriptions of the force-measuring means 20 and the position-measuring means 21, it will be realized that the directional drilling tool is cooperatively arranged to provide one set of output signals which are representative of the magnitudes and angular directions of the bending moments and the lateral forces that are acting on the earth-boring apparatus 14 and another set of output signals which are representative of the spatial position of the new and improved tool 10. As described, these output signals are transmitted to the surface by the data-signalling means 22 where they are detected and processed by way of typical signal-processing circuitry (not seen in the drawings) to provide suitable indications and records.

It will, of course, be appreciated that the directional measurements provided by the force-measuring means 20 are related to the X-axes 27 and 29 of the body 24. When the directional drilling tool 10 is rotating, the measurements from the force-measuring means 20 must, of course, be appropriately correlated with the directional measurements of the position-measuring means 21 to determine the true azimuthal orientations of the side force Fb and the bending moment Mb that are acting on the drill bit at any given time. The simplest way of correlating these two sets of directional measurements is to assume that the X-axis of the sensors in the accelerometer 41 (or the X-axis of the sensors in the magnetometer 40) is the reference axis for the tool 10 and obtain all of the measurements at the same time so that the only correction that is needed will be to account for the constantly changing angle (i.e., the angle as used in the following Equation 7) that will exist at any given time between the computed angular direction of the force Fb (or the computed angular direction of the bending moment Mb) and the previously-mentioned selected reference axis for the tool 10 (i.e., the X-axis of the sensors for either the magnetometer 40 or the accelerometer 41). It will also be appreciated that if the sensors that define the reference axis are mounted in another tool body than the body 24, it will not always be possible to angularly align the X-axes of the body 24 with the X-axis of the reference sensors when the several tool bodies are threadedly coupled together. Thus, it should be noted that where there are several tool bodies involved, an additional correction is also needed to account for any angular displacement (i.e., the angle K in the following Equation 7) that may result between the X-axes 27 and 29 of the body 24 and the X-axis of the reference sensors in the magnetometer 40 (or in the accelerometer 41) once the various bodies being incorporated into the new and improved directional drilling tool 10 have all been coupled into a unitary assembly. This will, of course, be a fixed constant or correction that applies only to that particular assembly of tool bodies.

Accordingly, to determine the azimuthal orientation of the lateral force Fb (or of the bending moment Mb) at any given time t, the following equation is employed:

$$\alpha_t = \phi_t \theta_t + K \qquad \text{Eq. 7}$$

where, $\alpha_t$=azimuthal orientation of lateral force Fb (or bending moment Mb) at time of measurement t $\theta_t$=azimuthal direction of local X-axis at time of measurement t measured from fixed reference axis of either magnetometer 40 or accelerometer 41

$\alpha_t$=angular direction of lateral force Fb (or bending moment Mb) at time of measurement t K=fixed correction angle for angular displacement between X-axes of force sensors in one tool body and magnetometer sensors (or accelerometer sensors) in other tool body after the assembly of those tool bodies into MWD tool 19

This basic correlation can, of course, be done either by sending the various signals separately to the surface for processing and combining there or in the MWD tool 19 itself by means of suitable downhole circuitry, such as at 45, which has been appropriately arranged to perform the directional computations as well as the previously-discussed computations of the transfer function. The several signals are then preferably combined by means of the additional downhole circuitry 44.

It will, of course, be appreciated that since any change in the angle of inclination and azimuthal direction of the tool 10 will ordinarily be gradual, these parameters do not have to be continuously measured. Thus, in practicing the methods of the present invention, it is preferred to make periodic measurements of the azimuthal orientation of the tool 10 and use them as a basis for computing the instantaneous azimuthal orientations of the lateral forces Fb and bending moments Mb that are measured at more frequent intervals between any two periodic measurements of the tool orientation. In the preferred manner of doing this, two or more piezoelectric accelerometers 46 and 47 are cooperatively mounted in enclosed, air-filled chambers on opposite sides of the body 24 and arranged for providing output signals representative of the rotational acceleration, $\delta\omega/\delta t$, of the tool 10 during the drilling operation. With this measurement, the instantaneous azimuthal orientation of the lateral force Fb or bending moment Mb at any given time, $t_1$, following a previous computation of the azimuthal orientation of the reference axis at some previous time, $t_0$, can be computed by means of the circuitry 44 by using this equation:

$$\alpha_1 = \phi_0 + \omega_0 * \Delta t + 0.5\left(\frac{\delta\omega}{\delta t}\right)(\Delta t) + \theta_1 + K \qquad \text{Eq. 8}$$

where, $\phi_0$=azimuthal orientation of tool reference axis at time $t_0$ $\omega_0$=rotational speed of tool at $t_0$ $\Delta t$=elapsed time between measurement of lateral force Fb (or bending moment Mb) and last measurement of $\phi_0$, i.e., $t_1$-$t_0$ $\theta_1$=angular direction of lateral force Fb (or bending moment Mb) at $t_1$ K=correction angle for angular displacement between X-axes of force sensors in one body and magnetometer (or accelerometer) sensors in other body after assembly of those bodies Once the output signals produced at any given time by the force-measuring means 21 have been converted as described above for determining the respective magnitudes and azimuthal orientations of the bending moment Mb and the lateral force Fb which are then acting on the drill bit 14, it will be seen that these measurements can be employed to determine the present and future courses of excavation of the borehole 15. Thus, as the signal-processing circuitry at the surface continues to process the successive output signals of the MWD tool 19 representative of the azimuthal orientation of the lateral force Fb, the operator will be able to determine with reasonable accuracy the azimuthal direction in which the drill bit 14 is then proceeding as well as to predict its probable future directional course.

It must also be recognized that the measurements of the bending moment acting on the drill bit 14 at any given moment are also of major signifigance since they are directly related to the character of the formation materials that are being penetrated at any given time by the bit. To understand the significance of the bending moment measurements, it must be realized that when purely homogeneous or isotropic formation materials are being excavated the bit 14 will be uniformly cutting away the formation materials in every sector of the bottom of the borehole 15. On the other hand, should the materials in one sector of the bottom surface of the borehole 15 be softer than the materials in the other sectors there will be a corresponding tendency for the bit 14 to cut away these softer materials faster than the harder materials in the other sectors. This unbalanced upward force on the bit 14 is, of course, a significant source of the bending moment Mb on the bit.

It will also be recognized that the bending moment Mb on the bit 14 produces a corresponding deflection of the bit in relation to its longitudinal axis. In other words, the bending moment Mb on the bit 14 tends to tilt it out of axial alignment with the central axis of the tool 10 and the drill string 11. Thus, the tilting of the bit 14 is proportionally representative of the rate at which the bit is presently moving above or below a straight-line projection of the longitudinal axis of the tool 10. Accordingly, if there is little or no bending moment Mb acting on the bit 14, it will generally continue drilling along a course of excavation which is the straight-line extension of the Z-axis or longitudinal axis of the tool 10 and the drill string 11. On the other hand, if the direction of the bending moment is found to be pointed upwardly, it may be assumed that the bit 14 is instead advancing along a gradual upwardly-inclined arc and that the rate of this upward movement is proportional to the computed magnitude of the bending moment Mb. The same analysis is applied when the directional measurements show that the bit 14 is subjected to an downwardly-directed moment. This latter measurement would, of course, indicate that the drill bit 14 was instead moving along a downwardly-inclined arc and it would be realized that the rate of this downward advancement is proportional to the magnitude of the bending moment Mb that was computed at that time.

Those skilled in the art will, of course, recognize that typical stress analysis procedures will be sufficient for determining the rates of the upward or downward movements of the drill bit 14. Thus, in practicing the new and improved methods of the present invention, the following equation is employed for determining the radius of curvature of an upwardly or downwardly-inclined path of advancement for the drill bit:

$$R = \eta * \frac{E * I}{Mb} \qquad \text{Eq. 9}$$

where,

R=radius of curvature of longitudinal axis of drill bit
E=Modulus of elasticity of bit
I=Moment of inertia of bit
$\eta$=function characteristic of nature of formation being penetrated These computations can be carried out either in the surface instrumentation or in the downhole measurement circuitry 44.

It will be recognized that Equation 9 is dependent on the nature of the formation being penetrated. This obviously represents an unknown parameter that must be determined if the radius of curvature of the drill bit 14 is to be computed. Thus, in practicing the methods of the invention, typical prediction corrector techniques are employed to compute the radius R. For example, if the formation characteristic $\eta$ for those formations that are then being drilled is arbitrarily assumed to have a value of 1, the corresponding radius can then be computed. Then, by making a series of successive directional measurements as that interval is being drilled, the actual radius R of that particular interval of the borehole 15 can be calculated. Using this actual radius R, Equation 9 can be solved for $\eta$ to arrive at a better value for the actual formation characteristic in this particular borehole interval. This later value of $\eta$ is, of course, used for computing R so as to arrive at a prediction of the radius to the borehole interval that will be drilled if no further changes are made in the course of the drill bit 14. It will, of course, be understood that the values of the formation characteristic $\eta$ will change as different types of formation materials are encountered so that there must be a continuous comparison of the predicted value of the radius R and the actual radius R as verified by the directional measurements of the new and improved directional tool 10. This iterative technique must be continuously used to verify the accuracy of the predicted course and radius of the borehole intervals that are yet to be drilled.

Those skilled in the art will appreciate that with the new and improved directional drilling tool 10 arranged as shown in FIG. 6, the various measurements described above can be used to control the course of excavation of any standard earth-boring apparatus such as the drill bit 14. Accordingly, as previously mentioned, when an ordinary drill bit is being used the operator can selectively change various drilling parameters and use the several measurements provided by the new and improved drilling tool 10 to achieve at least a minimal control of the direction of the course of excavation of the drill bit 14. Since the new and improved measurements of the directional drilling tool 10 will enable the operator to know when the drill bit 14 is starting to move away from a desired course of excavation, even such minimal controls will often suffice to allow the operator to return the drill bit to the desired course before it has strayed too far. In a similar fashion, the directional drilling tool 10 of the present invention can also be used with both a big-eye bit and a bent-sub directional tool. In either instance, the drilling operation would proceed with the new and improved directional drilling tool 10 providing the several directional measurements described above. Whenever it becomes evident that some course correction is needed, the big-eye bit or the bent sub tool are operated in their customary manner to initiate a change in the direction of the borehole being drilled. As described above, the new and improved methods of the present invention can be effectively utilized as needed to achieve the directional change by either the big-eye bit or the bent-sub tool.

Figure 7:
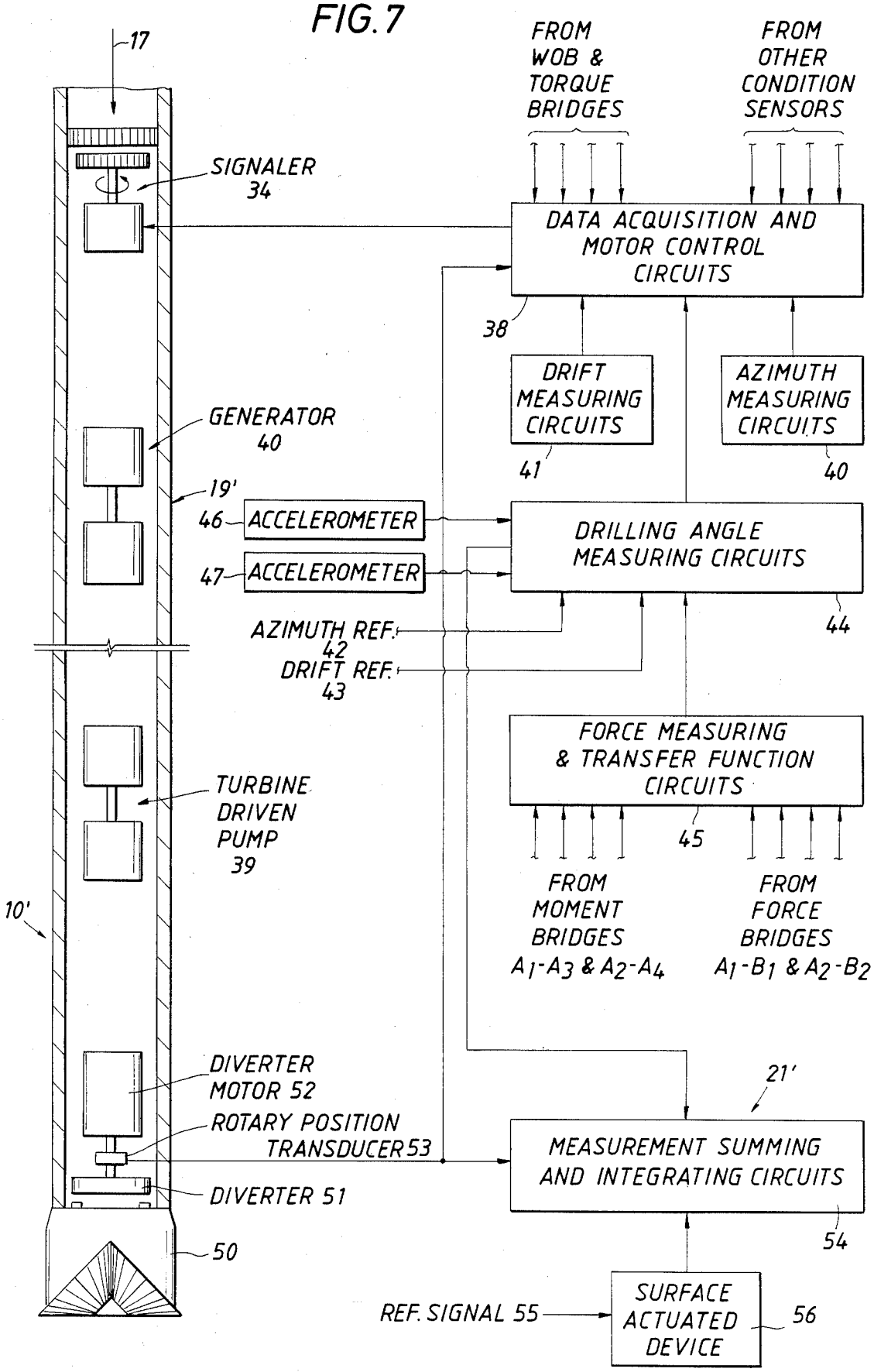
FIG. 7 is similar to FIG. 6 but depicts alternative circuitry and components whereby an otherwise-typical MWD tool can utilize the output signals from the force-measuring means of FIGS. 4A–4C for selectively controlling a uniquely-arranged directional drilling tool as well as providing suitable surface records and indications.

As an alternative, those skilled in the art will also recognize that the present invention can also be practiced in conjunction with the new and improved methods and apparatus shown in U.S. application Ser. No. 740,110 filed May 31, 1985, in the name of Lawrence J. Leising and assigned to the parent company of the assignee of the present application. As fully illustrated and described in the Leising application (which application is hereby incorporated by reference in the present application), as depicted in FIG. 7 of the drawings, a new and improved drill bit 50 (such as seen in FIG. 2 of the above-described Leising application) can be substituted for the typical drill bit 14. The directional drilling tool 10' shown in FIG. 7 is identical to the tool 10 already described by reference to FIG. 6 except that the flow of drilling mud into the drill bit 50 is controlled by means of a rotatable fluid diverter 51 that is selectively driven by a diverter motor 52 cooperatively arranged to rotate in either rotational direction and at various rotational speeds as needed to regulate the flow of mud through the respective mud ports of the drill bit 50. To provide suitable feedback control signals to the motor 52, a typical rotary position transducer 53 is operatively arranged on the shaft connecting the diverter to the motor for providing output signals that are representative of the rotational speed of the diverter 51 as well as its angular postion in relation to the alternative tool 10'. As is common, feedback signals from the transducer 53 are fed to appropriate summing-and-integrating circuits 54. The output signals from the transducer 53 are also coupled to the data-acquisition and motor-control circuitry 38 to provide output signals at the surface representative of the rotational speed and the angular position of the diverter 51 relative to the body of the tool 10'.

It will, of course, be recognized that suitable control means must also be provided for selectively changing the various modes of operation of the directional-drilling tool 10'. In one manner of accomplishing this, a reference signal source, as at 55, is cooperatively arranged to be selectively coupled to the servo driver 52 by means such as by a typical control device 56 mounted in the tool 10' and adapted to be operated in response to changes in some selected downhole condition which can be readily varied or controlled from the surface. For instance, the control device 56 could be chosen to be responsive to a predetermined change in the flow rate of the drilling mud in the drill string 11. Should this be the case, the directional control tool 10' could be readily changed from one operational mode to another desired mode by simply controlling the mud pumps (not depicted) as required to momentarily increase or decrease the flow rate of the drilling mud which is then circulating in the drill string 11 to some predetermined higher or lower flow rate. The control device 56 could just as well be chosen to be actuated in response to predetermined levels or variations in the aforementioned weight-on-bit measurements in the drill string 11. Conversely, an alternative remotely-actuated device 56 could be responsive to the passage of slugs of various radioactive tracer fluids in the drilling mud stream. Other means for selectively actuating the control device 56 will be apparent to those skilled in the art.

Accordingly, as fully described in the aforementioned Leising application, the directional drilling tool 10' is operated so that the motor 52 will selectively rotate the fluid diverter 51 as needed to accomplish any desired changes in the course of excavation of the drill bit 50 or to maintain it in a selected course of excavation. It will, of course, be appreciated that the continued diversion of the drill bit 50 in a selected lateral direction will progressively excavate the borehole 15 along an extended, somewhat-arcuate course. It is, however, not always feasible nor necessary to continue deviation of a given borehole as at 15. Thus, in keeping with the objects of the invention, the directional tool 10' is further arranged so that further diversion of the bit 50 can be selectively discontinued so that the bit will thereafter advance along a generally straight-line course of excavation. Thus, in the preferred manner of operating the tool 10', the remotely-actuated control device 56 is actuated (such as, for example, by momentarily changing the speed of the mud pumps at the surface) to cause the motor 52 to function to control the diverter 51 as needed to change the directional course of the bit 50. It will be recognized, therefore, by a review of the aforementioned Leising application that the new and improved tool 10' can be controlled as needed to selectively direct the drill bit 50 along a selected course of excavation.

Accordingly, it will be understood that the present invention has provided new and improved methods and apparatus for guiding well-boring apparatus of different designs along selected courses of excavation. By using the new and improved drilling tools disclosed herein, well-boring apparatus coupled thereto can be reliably advanced in any selected azimuthal course and at any selected inclination without removing the drill string or using special apparatus to effect a minor course correction.

While only particular embodiments of the apparatus of the present invention have been shown and described herein, it is apparent that various changes and modifications may be made without departing from the principles of the present invention in its broader aspects; and, therefore, the aim in the appended claims is to cover all such changes and modifications as fall within the true spirit and scope of this invention.

What is claimed is:

1. A method for determining the directional course of a borehole being excavated with rotatable earth-boring apparatus suspended from a tubular drill string comprising the steps of:

while said earth-boring apparatus is excavating a borehole, obtaining a first series of measurements representative of the magnitudes of the bending moments and lateral forces that are acting on said earth-boring apparatus;

obtaining a second series of measurements representative of the azimuthal directions of said bending moments and lateral forces acting on said earth-boring apparatus; and utilizing said first and second series of measurements for determining whether said earth-boring apparatus is then advancing along a selected course of excavation.

2. The method of claim 1 including the additional steps of:

whenever said measurements indicate said earth-boring apparatus is advancing along said selected course of excavation, utilizing said measurements of the azimuthal direction of said bending moments for determining whether said earth-boring apparatus is then advancing upwardly or downwardly in relation to the surface of the earth;

utilizing said measurement, of the azimuthal direction of said lateral forces for determining the azimuthal direction in which said earth-boring apparatus is then advancing; and combining said measurements for predicting the future course of advancement of said earth-boring apparatus.

3. The method of claim 1 including the additional steps of:

whenever said measurements indicate said earth-boring apparatus is not advancing along its said selected course of excavation, utilizing said bending moment measurements for determining whether said earth-boring apparatus is then advancing upwardly or downwardly in relation to the surface of the earth as well as for determining the radius of curvature of the present course of excavation of said earth-boring apparatus;

using said force measurements for determining the azimuthal direction of said present course of excavation of said earthboring apparatus; and redirecting said earth-boring apparatus toward said selected course of excavation.

4. A method for excavating a borehole with rotatable earth-boring apparatus suspended from a tubular drill string comprising the steps of:

while said earth-boring apparatus is excavating a borehole along a selected course of excavation, obtaining a first series of measurements representative of the magnitudes and azimuthal headings of the bending moments and lateral forces that may be tending to divert said earth-boring apparatus away from its said selected course of excavation during a first time period;

obtaining a second series of measurements representative of the magnitudes and azimuthal headings of said bending moments and lateral forces that may be tending to divert said earth-boring apparatus away from its said selected course of excavation at a subsequent second time period; and combining said first and second measurements for determining whether said earth-boring apparatus is advancing along its said selected course of excavation.

5. The method of claim 4 including the additional steps of:

whenever said measurements indicate said earth-boring apparatus is still advancing along its said selected course of excavation, using said first and second measurements of the azimuthal direction of said bending moments for determining whether said earth-boring apparatus is then advancing upwardly or is then advancing downwardly in relation to the surface of the earth;

combining said first and second measurements of the azimuthal direction of said lateral forces for determining the azimuthal direction in which said earth-boring apparatus is then advancing; and using said directional measurements for predicting the future course of advancement of said earth-boring apparatus.

6. The method of claim 4 including the additional steps of:

whenever said measurements indicate said earth-boring apparatus is not advancing along its said selected course of excavation, utilizing said first and second measurements of the azimuthal direction of said bending moments for determining whether said earth-boring apparatus is advancing upwardly or is advancing downwardly in relation to the surface of the earth;

combining said first and second measurements of the magnitude of said bending moments for determining the radius of curvature of the present course of excavation of said earth-boring apparatus;

combining said first and second measurments of said lateral forces for determining the azimuthal direction of said present course of excavation of said earth-boring apparatus; and thereafter redirecting said earth-boring apparatus toward its said selected course of excavation.

7. A method for determining the present course of earth-boring apparatus as it is excavating a borehole comprising the steps of:

while said earth-boring apparatus is excavating a borehole, measuring the magnitude and azimuthal direction of a bending moment that is then acting on said earth-boring apparatus;

measuring the magnitude and azimuthal direction of a side force that is then acting on said earth-boring apparatus; and determining the present directional course of said earth-boring apparatus resulting from said present bending moment and side force.

8. The method of claim 7 including the additional steps of:

while said earth-boring apparatus continues excavating said borehole, measuring the magnitude and azimuthal direction of a bending moment that is subsequently acting on said earth-boring apparatus;

measuring the magnitude and azimuthal direction of a side force that is subsequently acting on said earth-boring apparatus;

determining the subsequent directional course of said earth-boring apparatus resulting from said subsequent bending moment and side force; and comparing said present and subsequent directional courses of said earth-boring apparatus for determining whether said earth-boring apparatus is advancing along a selected course of excavation.

9. The method of claim 8 including the additional steps of:

whenever it is determined that said earth-boring apparatus is advancing along its said selected course of excavation, combining said subsequent and present directional courses of said earth-boring apparatus for predicting its future course of excavation.

10. The method of claim 8 including the additional steps of:

whenever it is determined that said earth-boring apparatus is not advancing along its said selected course of excavation, combining said subsequent and present azimuthal directions of said bending moments for determining whether said earth-boring apparatus is advancing upwardly or is advancing downwardly in relation to the surface of the earth;

combining said subsequent and present magnitudes of said bending moments for determining the curvature of said subsequent course of excavation of said earth-boring apparatus;

combining said subsequent and present azimuthal directions of said side forces for determining the azimuthal direction of said subsequent course of excavation of said earth-boring apparatus; and thereafter redirecting said earth-boring apparatus toward its said selected course of excavation.

11. A method for determining the lateral side forces acting on rotatable earth-boring apparatus suspended from a tubular drill string and comprising the steps of:

determining the elastic characteristics of the intervening portion of said drill string between said earth-boring apparatus and a force-measuring station located at a selected higher location in said drill string;

while said earth-boring apparatus is excavating a borehole, obtaining a force measurement representative of the angular direction and the magnitude of the laterally-directed shear forces acting on said force-measuring station at a selected time; and combining the elastic characteristics of said intervening drill string portion with said force measurement for determining the angular direction and magnitude of the corresponding lateral side forces acting on said earth-boring apparatus at said selected time.

12. The method of claim 11 further including the steps of:

obtaining another force measurement representative of the magnitude and angular direction of the laterally-directed shear forces acting on said force-measuring station at a selected later time;

combining the elastic characteristics of said intervening drill string portion with said other force measurement for determining the angular direction and magnitude of the corresponding lateral side forces acting on said earth-boring apparatus at said selected later time; and utilizing said lateral side forces respectively determined to be acting on said earth-boring apparatus at each of said selected times for determining the angular direction in which said earth-boring apparatus is being diverted.

13. The method of claim 11 further including the steps of:

obtaining another force measurement representative of the magnitude and angular direction of the laterally-directed shear forces acting on said force-measuring station at a selected later time;

combining the elastic characteristics of said intervening drill string portion with said other force measurement for determining the angular direction and magnitude of the corresponding lateral side forces acting on said earth-boring apparatus at said selected later time;

obtaining a directional measurement representative of the azimuthal direction in which said earth-boring apparatus is advancing at said selected later time; and thereafter utilizing said directional measurement with said angular direction of said corresponding lateral side forces acting on said earth-boring apparatus at said selected later time for determining the azimuthal direction in which said earth-boring apparatus is being diverted.

14. The method of claim 13 further including the step of: redirecting said earth-boring apparatus in a selected azimuthal direction whenever it is determined that said earth-boring apparatus is being diverted in an unwanted azimuthal direction.

15. A method for determining the directional course of earth-boring apparatus suspended from a tubular drill string as said earth-boring apparatus is excavating a borehole and comprising the steps of:

determining the elastic characteristics of the intervening portion of said drill string between said earth-boring apparatus and a force-measuring station located at a selected higher location in said drill string;

at selected times during the excavation of a borehole by said earth-boring apparatus, successively obtaining a series of first force measurements representative of the angular directions and magnitudes of the laterally-directed shear forces acting on said force-measuring station and a series of second force measurements representative of the angular directions and magnitudes of the bending moments acting on said force-measuring station; and combining the elastic characteristics of said intervening drill string portion with said first and second force measurements for successively determining the angular directions and magnitudes of the lateral side forces and bending moments respectively acting on said earth-boring apparatus at said selected times.

16. The method of claim 15 further including the steps of:

successively obtaining directional measurements representative of the present directional course of advancement of said earth-boring apparatus at said selected times; and successively utilizing said directional measurements with the angular directions and magnitudes of the lateral side forces and bending moments acting on said earth-boring apparatus for predicting the future directional course of advancement of said earth-boring apparatus.

17. The method of claim 16 further including the step of:

whenever said predictions indicate that said future directional course of advancement of said earth-boring apparatus will be along a selected course of advancement, continuing to direct said earth-boring apparatus along its present directional course.

18. The method of claim 16 further including the step of:

whenever said predictions indicate that said future directional course of advancement of said earth-boring apparatus will not be along a selected course of advancement, redirecting said earth-boring apparatus toward said selected course of advancement.

19. Apparatus adapted for measuring downhole load conditions while drilling a borehole and comprising:

a tubular load-bearing body adapted to be tandemly coupled in a tubular drill string and having upper and lower groups of lateral openings respectively arranged at circumferentially-spaced intervals around longitudinally-spaced upper and lower portions of said body;

a first set of force-sensing means respectively mounted in a first group of said lateral openings and cooperatively arranged for respectively producing output signals representative of bending moments acting on the adjacent portion of said body; and a second set of force-sensing means respectively mounted in each of said upper and lower lateral openings cooperatively arranged for respectively producing output signals representative of laterally-directed shear forces acting on the adjacent portion of said body.

20. The apparatus of claim 19 wherein said first group of lateral openings include four openings spaced at 90-degree intervals around said body and cooperatively arranged around intersecting X and Y axes lying in a common transverse plane so that said first and second pairs of said first force-sensing means will be in opposed pairs of said first openings for respectively producing output signals representative of the bending moments acting on said body around said X and Y axes.

21. The apparatus of claim 20 wherein said first group of lateral openings are above said second group of lateral openings.

22. The apparatus of claim 19 wherein each of said upper lateral openings are directly over a corresponding one of said lower lateral openings so that each pair of said second force-sensing means will be located in a common longitudinal plane for respectively producing output signals representative of the laterally-directed shear forces acting on that portion of said body lying in said common longitudinal plane.

23. Apparatus adapted for measuring downhole load conditions while excavating a borehole and comprising:

a tubular load-bearing body adapted to be tandemly coupled in a tubular drill string and having upper and lower groups of lateral openings respectively arranged at circumferentially-spaced intervals around longitudinally-spaced upper and lower portions of said body;

a first set of force-sensing means cooperatively arranged in a first group of said lateral openings and including at least two force sensors respectively mounted at the top and bottom of each of said first lateral openings for producing output signals representative of bending moments acting on the adjacent portion of said body; and a second set of force-sensing means cooperatively arranged in said upper and lower lateral openings and including at least two force sensors respectively mounted on opposite sides of each of said upper and lower lateral openings for producing output signals representative of laterally-directed shear forces acting on the adjacent portion of said body.

24. The apparatus of claim 23 further including:

a third set of force-sensing means cooperatively arranged in one group of said lateral openings and including at least two force sensors respectively mounted on opposite sides of each of one opposed pair of said lateral openings in that group for producing output signals representative of torque forces acting on the adjacent portion of said body.

25. The apparatus of claim 23 further including:

a third set of force-sensing means cooperatively arranged in one group of said lateral openings and including at least two force sensors respectively mounted on opposite sides of each of one opposed pair of said lateral openings in that group for producing output signals representative of longitudinal forces acting on the adjacent portion of said body.

26. The apparatus of claim 25 further including:

a fourth set of force-sensing means cooperatively arranged in one group of said lateral openings and including at least two force sensors respectively mounted on opposite sides of each of the other opposed pair of said lateral openings in that group for producing output signals representative of torque forces acting on the adjacent portion of said body.

27. Apparatus adapted for determining the directional course of a borehole being excavated with rotatable earth-boring apparatus suspended from a tubular drill string and comprising:

means for obtaining measurements representative of the magnitudes of bending moments and lateral forces that are acting on earth-boring apparatus excavating a borehole;

means for obtaining measurements representative of the azimuthal directions of said bending moments and lateral forces that are acting on said earth-boring apparatus; and means for combining said measurements for determining whether said earth-boring apparatus is advancing along a selected course of excavation.

28. The apparatus of claim 27 further including means cooperatively arranged on said earth-boring apparatus for selectively directing its course of excavation.

29. Apparatus adapted for determining the directional course of a borehole being excavated with rotatable earth-boring apparatus suspended from a tubular drill string and comprising:

means defining a force-measuring station adapted to be located at a selected location in a tubular drill string supporting earth-boring apparatus adapted to be rotated for excavating a borehole;

means adapted for successively measuring forces representative of the angular directions and magnitudes of the laterally-directed shear forces acting on said force-measuring station;

means adapted for successively measuring forces representative of the angular directions and magnitudes of the bending moments acting on said force-measuring station; and means adapted for combining the elastic characteristics of the intervening portion of said drill string with said measurements for successively determining the angular directions and the magnitudes of the lateral side forces and bending moments respectively acting on said earth-boring apparatus.

30. The apparatus of claim 29 further including:

means adapted for successively obtaining directional measurements representative of the directional course of advancement of said earth-boring apparatuss; and means adapted for successively utilizing said directional measurements with the angular directions and magnitudes of the lateral side forces and bending moments acting on said earth-boring apparatus for determining the directional course of said earth-boring apparatus.

* * * * *